US005496588A

United States Patent [19]

Maitra et al.

[11] Patent Number: 5,496,588

[45] Date of Patent: Mar. 5, 1996

[54] METHOD AND APPARATUS FOR GALVANIZING LINEAR MATERIALS

[75] Inventors: Kalyan K. Maitra, Flossmoor; Daniel G. McInerney, Chicago; Carl H. Unger, Oak Lawn, all of Ill.

[73] Assignee: Allied Tube & Conduit Corp., Harvey, Ill.

[21] Appl. No.: 337,865

[22] Filed: Nov. 14, 1994

Related U.S. Application Data

[63] Continuation of Ser. No. 26,432, Mar. 4, 1993, Pat. No. 5,364,661.

[51] Int. Cl.[6] ..... B05D 3/04

[52] U.S. Cl. ..... 427/309; 427/321; 427/433; 427/436; 427/443.2

[58] Field of Search ..... 427/433, 443.2, 427/436, 309, 321

[56] References Cited

U.S. PATENT DOCUMENTS

| | | | |
|---|---|---|---|
| 1,682,823 | 9/1928 | Barord . | |
| 2,094,583 | 10/1937 | Cook et al. . | |
| 2,185,701 | 1/1940 | Boyle . | |
| 3,155,545 | 11/1964 | Rocks et al. . | |
| 3,226,817 | 1/1966 | Simborg et al. . | |
| 3,259,148 | 7/1966 | Krengel et al. | 138/145 |
| 3,407,099 | 10/1968 | Schell . | |
| 3,620,805 | 11/1971 | Martin . | |
| 3,877,975 | 4/1975 | Raymond . | |
| 3,908,593 | 9/1975 | Rossi et al. . | |
| 4,064,295 | 12/1977 | Singer | 427/424 |
| 4,254,158 | 3/1981 | Fukuzuka et al. | 427/422 |
| 4,352,838 | 10/1982 | Bostroem | 427/422 |
| 4,619,845 | 10/1986 | Ayers et al. | 427/422 |
| 4,657,787 | 4/1987 | Singer et al. | 427/422 |
| 4,774,906 | 10/1988 | Lu . | |
| 4,814,210 | 3/1989 | Ackermann . | |
| 4,904,497 | 2/1990 | Lewis . | |
| 4,915,906 | 4/1990 | Champagne et al. | 427/422 |
| 5,113,557 | 5/1992 | Maitra et al. . | |
| 5,152,323 | 10/1992 | Shotts et al. . | |

OTHER PUBLICATIONS

Harold E. McGannon, *The Making, Shaping and Treating of Steel*, pp. 930–931, 1031–1033 (1971).

*Primary Examiner*—Benjamin Utech
*Attorney, Agent, or Firm*—Banner & Allegretti, Ltd.

[57] ABSTRACT

A method and apparatus for continuous galvanizing of a linear element wherein controlled flow of molten zinc onto the linear element is effected through one or more nozzles, whereby galvanizing may be accomplished without immersion of the linear element in molten zinc. In a preferred embodiment, the apparatus of the invention comprises an annular nozzle having a central opening through which the linear element is axially advanced. The nozzle is configured to provide a converging, generally frustoconical curtain of molten zinc flowing continuously onto the exterior surface of the linear element.

7 Claims, 2 Drawing Sheets

METHOD AND APPARATUS FOR GALVANIZING LINEAR MATERIALS

This is a continuation of application Ser. No. 08/026,432, filed Mar. 4, 1993, now U.S. Pat. No. 5,364,661, issued Nov. 15, 1994.

BACKGROUND OF THE INVENTION

This invention relates to a continuous process for galvanizing linear materials such as wire, rod, tube or pipe, by immersing the axially moving linear element incrementally in molten zinc.

The galvanization of the exterior surface of pipe or conduit as part of the continuous manufacture thereof from an endless strip of sheet metal has been practiced commercially for a number of years. The process basically consists of roll-forming the metal strip into tubular form after drawing it from an endless supply, welding the seam, scarfing and dressing off the weld, and passing the continuously formed tube through a pickling bath and rinse. The tube is then passed through a preheating station and then through a bath of molten zinc, after which the excess zinc is removed, the tube cooled to handling temperature in a water bath, and the tube sheared into finite lengths. The tube may be subjected to a sizing operation after being cooled, prior to the sheafing operation.

Such an integrated continuous manufacturing process is disclosed, for example, in U.S. Pat. No. 3,226,817, with particular emphasis on the galvanization step of the process in U.S. Pat. Nos. 3,226,817, 3,259,148 and 3,877,975.

In the galvanizing stations of such prior integrated processes, the continuously-formed, rapidly moving tube, after appropriate preparation, was passed through an elongated trough positioned above a pool of molten zinc in a large vat, from which a stream of the liquid metal was pumped to maintain a substantial and overflowing body of molten zinc in the trough as well as to replace the zinc being carried away from the trough as a fluid coating on the tube.

As described in co-pending application No. 07/892,432, now abandoned it has recently been found that coating of linear elements in a continuous galvanizing process may be effected by immersion of the linear elements in molten zinc in an open tube, with zinc flowing out of the opposite ends of the tube. This arrangement enables galvanizing to be accomplished with reduced zinc flow as compared with prior methods employing overflowing troughs. Reduction of zinc flow is generally desirable due to the consequent reduction of the corrosive and abrasive effects of molten zinc on pump components and other system components.

SUMMARY OF THE INVENTION

The invention relates to a method and apparatus for continuous galvanizing of a linear element wherein controlled flow of molten zinc onto the linear element is effected through one or more nozzles, whereby galvanizing may be accomplished without immersion of the linear element in molten zinc.

In a preferred embodiment, the apparatus of the invention comprises an annular nozzle having a central opening through which the linear element is axially advanced. The nozzle is configured to provide a converging, generally frustoconical orifice which projects a converging conical curtain of molten zinc. The axial component of the velocity of the molten zinc is preferably oriented in the direction of advancement of the linear element.

The nozzle is preferably supplied with molten zinc from a bath contained in a vat below the nozzle. The molten zinc is pumped upward to the nozzle through a generally vertical riser. The preferred nozzle is configured such that, upon cessation of pump operation, molten zinc contained in the nozzle drains downward through the riser to avoid pooling of molten zinc and subsequent solidification thereof in the nozzle interior.

In accordance with a further aspect of the invention, effective galvanizing may be accomplished with a reaction time of less than one second.

Additional aspects of the invention are set forth below.

BRIEF DESCRIPTION OF THE DRAWINGS

The invention is described in reference to the accompanying drawings, in which.

DETAILED DESCRIPTION OF THE PREFERRED EMBODIMENTS

Figures 1, 4, 5:
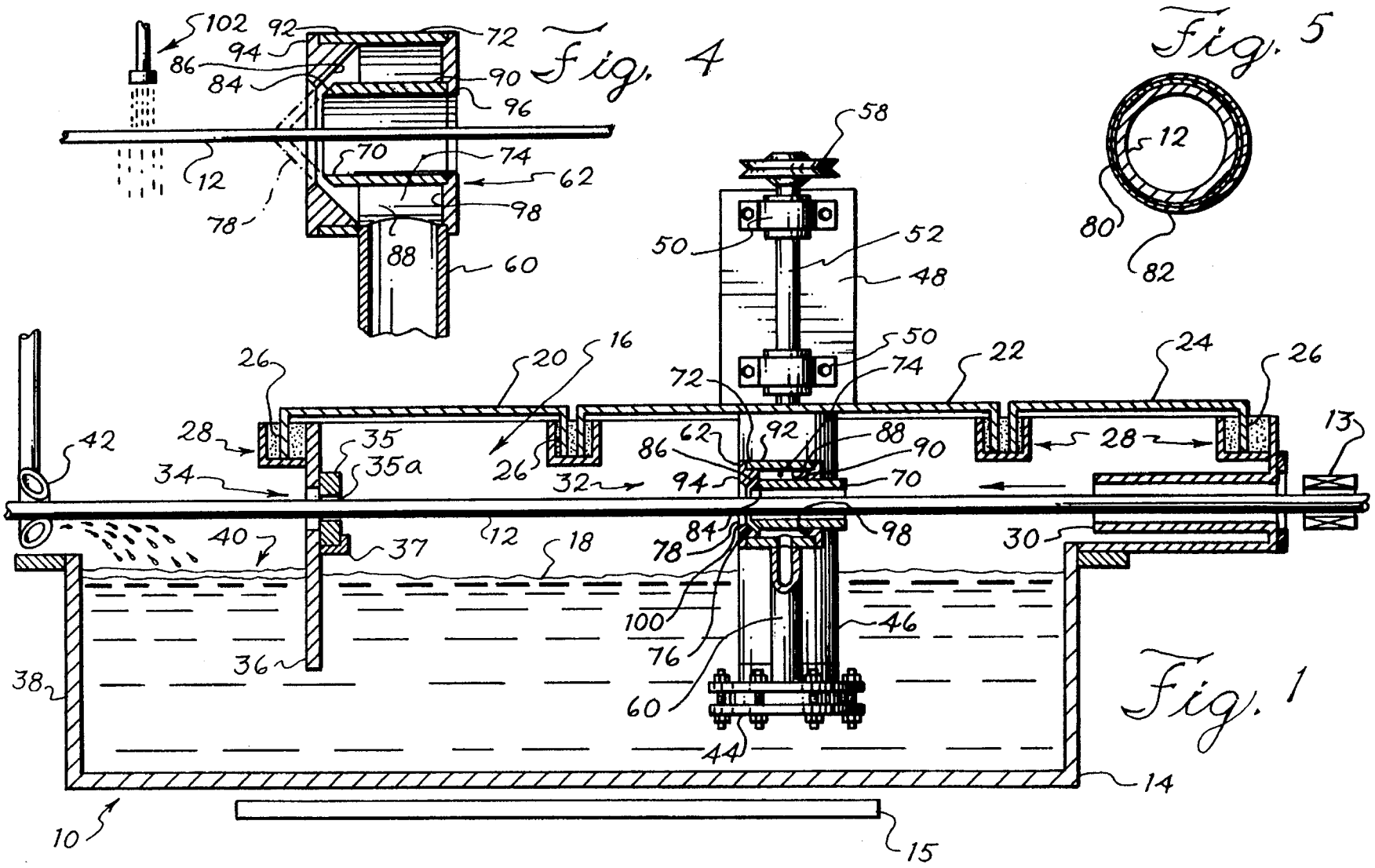
FIG. 1 is a diagrammatic, longitudinally sectioned elevational view of a galvanizing station in accordance with the invention, as installed in an integrated line for the continuous manufacture of galvanized steel tube or pipe.
FIG. 4 is an enlarged longitudinal sectional view of the apparatus in accordance with a modified embodiment of the invention.
FIG. 5 is an enlarged transverse sectional view of a tubular element galvanized in accordance with the invention.
Figure 3:
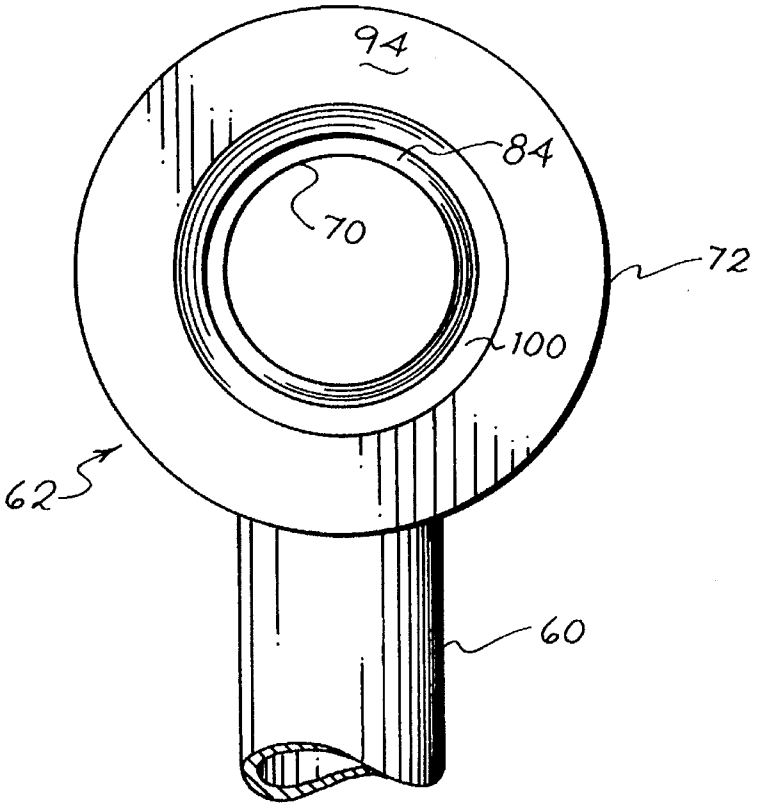
FIG. 3 is an enlarged end view of a nozzle in accordance with the invention.
Figure 2:
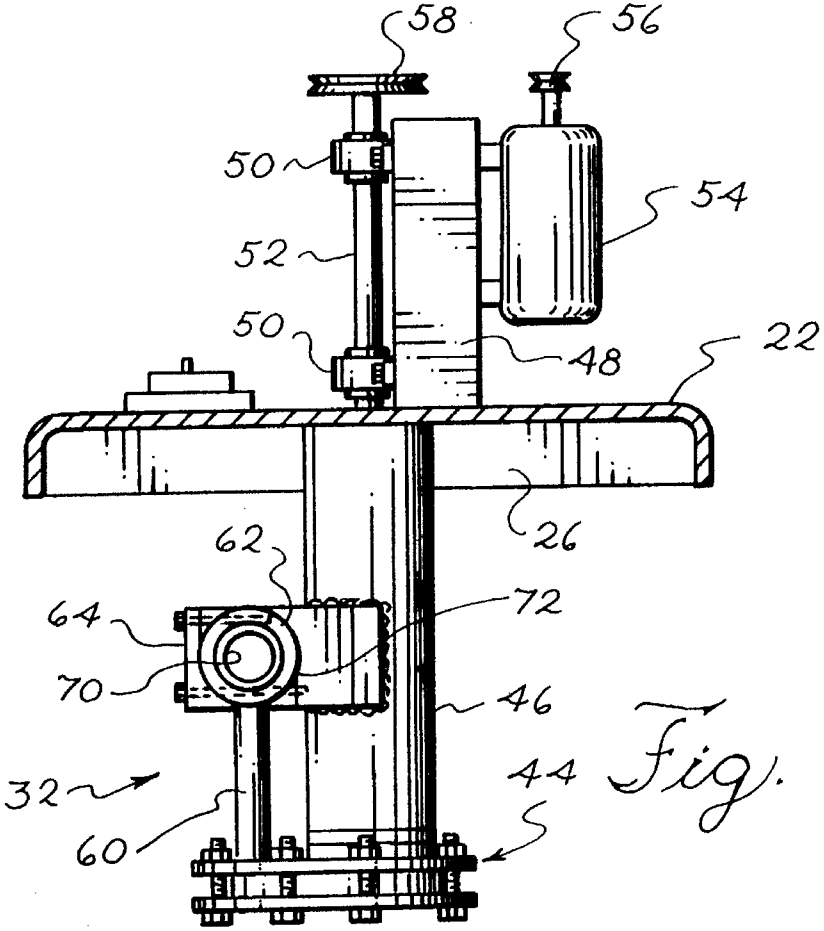
FIG. 2 is a transverse sectional view of the apparatus of FIG. 1, and shown on an enlarged scale.

Referring to FIGS. 1 and 2 for a general description of the method and apparatus of the invention, FIG. 1 shows a galvanizing station 10 in a system for the continuous manufacture of galvanized pipe or conduit 12. While the method and apparatus illustrated were developed in the stated context, the inventions is believed applicable to the continuous galvanization of other iron or steel linear elements such as wire or rod.

The conduit 12 passes through the galvanizing station from right to left as viewed in FIG. 1, delivered in rapid axial motion from a roll-forming station where an endless band of metal is progressively rolled into tubular form with abutting edges which are closed by an electrically welded seam which is scarfed and dressed en route to the galvanizing station. In preparation for galvanizing, the conduit is first cleaned by a pickling bath of acid, followed by a neutralizing rinse, after which the tube is preheated in an inert gas atmosphere immediately before entry into the galvanizing station. Preheating is conveniently accomplished by passing the conduit axially through an induction heating coil 13. As these pregalvanizing steps are well understood in the art, they are not here shown, reference simply being made to the Krengel patent, U.S. Pat. No. 3,259,148, in which one such system is illustrated and described.

The galvanizing station 10 comprises an elongated vat 14 of molten zinc constructed in generally rectangular form of welded steel plate and formed to provide a space 16 above the predetermined level of the pool 18 of liquid zinc therein, maintained in molten condition at about 850° F., i.e., about 50° F. above the melting point of zinc. While the zinc may be maintained at any temperature above its melting point, where unlined steel vats and pumps are used, it is preferred that its temperature not exceed 900° F., due to the increased wear of apparatus contacting zinc at temperatures over 900° F. Higher temperatures may be used where ceramic-lined equipment is employed. The heating means may be, gas or oil burners 15 directed against the walls of the vat or electric induction heaters.

Generally, it is desirable to preheat the tube to a temperature approximately equal to that of the molten zinc to be applied to the tube. Under certain circumstances, for example, where oil is present on the tubing, it may be desirable to preheat the tube to temperatures as much as 100° F. greater than that of the molten zinc.

In the illustrated embodiment, the space 16 above the pool of liquid zinc is closed by a series of covers 20, 22, and 24 having downwardly extending perimeter flanges 26 which are received in troughs 28 extending around the periphery of the vat and transversely of the vat, as well, to permit the use of multiple covers for convenient access to the interior of the vat for maintenance purposes. Fewer covers or more covers may be employed in other embodiments. The troughs 28 in which the cover flanges are received are partially filled with a granular material, such as sand, which forms a barrier to the escape of the inert gas with which the space 16 above the molten zinc is filled and maintained slightly above atmospheric pressure to prevent, or at least limit, the entry of air into that space.

As earlier noted, the conduit 12 enters the galvanizing station from the right immediately from the preheater, the housing for which is normally abutted against the entering end of the galvanizing station with an intervening packing of mineral wool or the like to limit the entrainment of ambient air into the galvanizing zone above the molten metal. The conduit enters the station 10 through a hole in the vat wall and thence through a larger tube 30 intended to bring the conduit into more intimate contact with the inert purging gas. The tube then passes through the galvanizing apparatus 32 of the invention and exits the galvanizing zone through an aligned hole 34 in the far wall 36 of the space. A block 35 having an opening 35*a* which is similar in shape to, and only slightly larger than, the cross-section of the linear element 12, provides initial wiping and support for the linear element 12 adjacent the hole 34. The block is supported on a bracket 37 which permits easy installation and removal of the block. For linear elements of different sizes or shapes, different block having corresponding sizes and shapes may be used.

It will be noted that the far wall 36 of the space is positioned above and extends downwardly into the pool 18 of molten zinc at some distance removed from the end wall 38 of the vat proper, providing a small area 40 of open access to the pool of zinc through which the inventory of molten zinc is maintained by the periodic addition of pigs of the metal. That open area also serves the further purpose of receiving the molten zinc trimmed from the outer surface of the conduit 12 by an air knife 42 which delivers a cuffing stream of compressed air through an annular nozzle aperture onto the surface of the conduit to trim the excess zinc therefrom, propelling the same in a flat trajectory onto the exposed area 40 of the pool of molten zinc.

Generally, it is desirable to maximize the linear velocity of the workpiece 12 during the operation. However, the liner velocity that may be achieved is, as a practical matter, subject to limitations imposed by various aspects of the galvanizing process. In one embodiment of the invention, the velocity of the linear element 12 is about 600 feet per minute. In other embodiments, the linear elements may be advanced at other velocities which may be in the range of 90–1000 feet per minute.

The galvanizing apparatus 32 is shown mounted on the central vat cover 22. It comprises a submersible centrifugal pump 44 secured as by welding to the lower end of a thick-walled mounting pipe 46 welded to the underside of the vat cover. Supporting structure 48 mounted on the upper side of the cover 22 provides two bearings 50 for the vertical shaft 52 of the pump, which is driven at its upper end from a variable speed, vertical electric motor 54 by a V-belt entrained on a pair of speed-reducing pulleys 56 and 58. At its lower end, there is keyed onto the shaft 52 a double-sided pump impeller (not shown) which when rotating draws the molten zinc from the pool through a central intake in the bottom plate of the pump and a similar central hole in the top plate of the pump, through which the shaft 52 passes with wide clearance to admit the zinc to the upper impeller blades. Access by the liquid zinc to the upper central opening is provided by ports in the supporting structure between the upper plate of the pump and the mounting pipe 46. The mounting pipe 46 completely shrouds the pump shaft from the inert gas in the space 16, eliminating the need for shaft seals between the shaft 52 and cover 22 to prevent the escape of the gas.

The pump delivers the molten zinc to a riser pipe 60 which carries the liquid metal upwardly to an annular nozzle 62. To support the nozzle, a pair of brackets 64, welded to the mounting pipe 46 of the pump, encircle the nozzle 62 in a split-block configuration in which the two parts of each bracket are secured together by screws.

The illustrated nozzle 62 comprises coaxial inner and outer members 70 and 72 defining an annular space 74 therebetween. The outer member 72 comprises a substantially cylindrical wall 92 with an inwardly-extending ring 94 at its forward end. The inner member 70 and outer wall 92 may comprise respective coaxial lengths of pipe having a wall thickness of ½ in. Opposed coaxial inner and outer frustoconical surfaces 84 and 86 on the respective inner and outer members 70 and 72 define an annular slot or aperture 76 at the forward end of the nozzle providing a frustoconical orifice having its imaginary apex located on the axis of the inner member 70, downstream of the nozzle, i.e., to the left as seen in FIGS. 1 and 4. In one embodiment of the invention, the slot has a width or radial dimension of about ¼ in. about its entire circumference. In another embodiment, the slot width is ⅛ in. A back wall 96 joins the inner and outer members at the opposite end of the nozzle.

The linear element travels generally axially of the cylindrical members 70 and 72, extending through an opening in the inner member 70. During operation, molten zinc flows upward through the riser pipe 60 into the space 74, then through the orifice slot 76. The slot 76 is configured to direct flow of molten zinc generally forward (i.e., in the direction of travel of the linear element 12) and radially inward (i.e., toward the linear element). Preferably, the flow velocity is less than the velocity of the linear element. The nozzle thus provides a converging, generally conical curtain 78 of molten zinc flowing through the inert gas from the nozzle orifice to the surface of the linear element. In the illustrated embodiment, the slot is at an angle of about 45° to the axis of the linear element, so that the radial component of flow velocity is approximately equal to the axial component thereof, subject to variations in flow velocity due to gravity. In other embodiments, different angles may be selected. It is desirable that the angle permit application of molten zinc without back flow of zinc into the interior of the inner member 70.

As the surface of the linear element is wetted, an intermetallic alloy layer begins to form at the interface between the zinc and the ferrous base metal. The thickness and composition of the intermetallic alloy layer are affected by the length of the reaction time (i.e., the period of time during which the zinc in liquid phase contacts the linear element), as well as by the temperature of the linear element and bath, and by the alloy composition of the bath. Conventional hot dip-coating galvanizing operations have typically employed a reaction time of at least 2 to 3 minutes for pipes and tubes. Prior art continuous galvanizing of conduits typically employed a reaction time of 2 to 3 seconds. In accordance with an aspect of the invention, satisfactory galvanization may be accomplished with shorter reaction times, e.g., less than one second. It is believed that satisfactory results may be obtained, using the method of the invention, with as little as ⅓ second reaction time, albeit with a reduction in the thickness of the intermetallic alloy layer. This enables rapid cooling of the coating to be effected by a quench spray disposed a relatively short distance downstream from the nozzle 62, as shown in FIG. 4.

As noted above, the term "reaction time" as used herein denotes the time during which zinc in liquid phase contacts the linear element. In the context of methods of continuous galvanizing known in the prior art, reaction time includes immersion time and the time immediately following immersion before quenching. During the latter time period, molten zinc remains in liquid phase on the surface of the linear element. In the context of the preferred embodiment of the present invention wherein the linear element is not immersed in the molten zinc at all, the reaction time is the time elapsed between application of molten zinc quenching, of a particular portion of the linear element.

The thickness and other properties of the intermetallic alloy layer may also be affected by the addition of aluminum or other materials to the molten zinc. In the preferred embodiment of the invention, the molten zinc contains about 0.05%–0.11% aluminum.

It has been found that by employment of methods in accordance with the invention, a galvanized tube may be produced with an intermetallic alloy layer 80 having a thickness of about 0.1 to 0.3 mils, and a layer 82 of zinc having a thickness of about 0.5 to 2 mils.

While the illustrated embodiment shows galvanization of a generally circular-cylindrical tube, the method of the invention enables galvanization of linear elements of various other welded cross-sectional configurations as well, e.g., rectangular, oval or half-moon shaped linear elements. In other embodiments, the invention may be employed to galvanize angle iron, C-channel or other unwelded formed strips or shapes. The invention may be employed to galvanize such unwelded linear elements in line with a roll forming operation.

The invention enables satisfactory coating results to be obtained with relatively low flow volume of the molten zinc as compared with methods and apparatus employed in the prior art. In the context of galvanizing longitudinally seamed tubular elements, the invention also provides a significant advantage in the event of an open seam incident, wherein the integrity of the seam is interrupted for an interval in the range of a few inches to several feet. In prior galvanizing methods, molten zinc flowing into the open seam would typically result in significant line downtime and require a significant portion of the tubular element to be scrapped. In the method of the invention, penetration of zinc through an open seam is greatly reduced or eliminated, with consequent reduction or elimination of the adverse consequences mentioned above.

A practical problem in operation of apparatus in accordance with the invention is the risk of the nozzle being wholly or partially obstructed by freezing of zinc, particularly during an interruption of the galvanizing operation during which pumping of molten zinc is halted. This problem is addressed in the preferred embodiment of the invention by configuring the interior surfaces of the nozzle to provide for drainage of molten zinc in the event of an interruption of flow.

In the embodiment shown in FIG. 1, the interior surfaces of the nozzle comprise a substantially cylindrical interior surface 88 of the outer member 72 of the nozzle 62; a substantially cylindrical exterior surface 90 of the inner member 70 of the nozzle; a substantially vertical and planar inner surface 98 of the back wall 96; and the frustoconical slot-defining surfaces 84 and 86. At the nozzle outlet, drainage is further facilitated by providing a frustoconical rim 100 exteriorly of the slot 76. In the event of pump stoppage, molten zinc drains from the interior surfaces of the nozzle into the riser 60 and thence back through the pump 44 into the pool 18 of liquid zinc contained in the vat 14. Molten zinc drains from the frustoconical rim 100 directly into the pool 18.

A nozzle in accordance with a second embodiment of the invention is illustrated in FIG. 4, with the reference numerals used in connection with FIG. 1 denoting similar components. As illustrated by FIG. 4, the method and apparatus of the invention may be employed for galvanizing linear elements having a small outer diameter relative to the inner diameter of the inner member 70 of the nozzle, in addition to being employed for larger-diameter elements as shown in FIG. 1.

The invention is not limited to the embodiments described above, nor to any particular embodiments. While the invention as specifically illustrated in FIGS. 1 and 2 employs to advantage the submersible centrifugal pump 14, the invention in its broader aspects is not dependent upon a specific form of pump. Other kinds of pumps, for example, non-contact electromagnetic pumps, may also be employed, although preferably with suitable provision for the variable delivery rate achieved by speed control of the mechanical pump illustrated. Furthermore, while the illustrated nozzle is fabricated by welding together four separate pieces, the nozzle may alternatively be assembled from a greater or lesser number of components, one or more of which may be castings of a material and thickness capable of withstanding the corrosive and abrasive effects of the molten zinc. The nozzle may comprise two castings, with one including the inner member and back wall, and the other comprising the outer member and vertical riser pipe. This enables the slot width to be selected by insertion of shims of appropriate thickness between the back wall and the outer member. The castings are preferably made of an abrasion-resistant, corrosion-resistant cast iron complying with ASTM standard specification A532 IIIA, and having the following further specifications:

Chemistry:

T.C. 2.50–2.80 weight %
Si 0.50–0.75 weight %
Mn 0.50–0.90 weight %
P 0.10 Max weight %

S 0.10 Max weight %
Cr 25.0–28.0 weight %

Hardness: 550–650BHN (Re 55–62)

Heat Treatment: Solution anneal at 1850° F. for 4 hrs. air quench stress relieve at 450° F. for 4 hrs.

From the foregoing, it should be appreciated that the invention provides a novel and useful method and apparatus for continuous galvanizing of linear elements. The invention is further described in the following claims.

What is claimed is:

1. In a continuous process for galvanizing metal conduit, a method of applying molten zinc to a cleansed and preheated metal conduit to be galvanized comprising:

rolling a band of metal into tubular form having an outside surface with abutting edges;

welding the abutting edges to form said conduit;

cleaning said conduit with acid;

rinsing said conduit;

preheating said conduit in an inert atmosphere;

providing a source of molten zinc;

providing an inert gaseous environment over said source;

propelling a jet of molten zinc from said source through said gaseous environment;

passing said conduit axially through said jet, so that each point on said outside surface of said conduit makes contact with said jet for less than 0.1 second, whereby said outside surface of said conduit is coated with molten zinc and is galvanized.

2. A process, as claimed in claim 1, wherein said jet is 0.25 inch wide or less and said conduit is passed through said jet at a speed of at least 600 feet per minute.

3. A process, as claimed in claim 1, wherein each point on said outside surface of said conduit makes contact with said jet through a distance of less than 0.4 inch and said conduit is passed through said jet at a speed of at least 600 feet per minute.

4. A process, as claimed in claim 1, wherein said jet is propelled in the direction of axial movement of said conduit.

5. A process, as claimed in claim 1, wherein said conduit comprises iron and further comprising the step of cooling said coated conduit to solidify said coating after a lapse of time from application sufficient to develop a zinc-iron intermetallic alloy layer upon the surface of said conduit beneath the zinc coating.

6. A process, as claimed in claim 5, wherein the temperature of said conduit after heating is in the range of from 850 degrees F. to 950 degrees F., and said lapse of time is less than 1 second.

7. A process, as claimed in claim 6, wherein said lapse of time is about one third second.

* * * * *